US009544706B1

(12) United States Patent
Hirst

(10) Patent No.: US 9,544,706 B1
(45) Date of Patent: Jan. 10, 2017

(54) CUSTOMIZED HEAD-RELATED TRANSFER FUNCTIONS

(71) Applicant: Amazon Technologies, Inc., Seattle, WA (US)

(72) Inventor: Alistair Robert Hirst, Redmond, WA (US)

(73) Assignee: Amazon Technologies, Inc., Seattle, WA (US)

( * ) Notice: Subject to any disclaimer, the term of this patent is extended or adjusted under 35 U.S.C. 154(b) by 10 days.

(21) Appl. No.: 14/666,253

(22) Filed: Mar. 23, 2015

(51) Int. Cl.
*H04R 5/00* (2006.01)
*H04S 7/00* (2006.01)
*H04S 1/00* (2006.01)

(52) U.S. Cl.
CPC ..... *H04S 7/302* (2013.01); *H04S 1/00* (2013.01); *H04S 2420/01* (2013.01)

(58) Field of Classification Search
CPC .... H04S 2420/01; H04S 2400/11; H04S 7/30; H04S 7/302; H04S 7/306; H04S 7/307; H04S 7/40; H04S 3/004; H04S 3/008; H04S 1/00; H04S 1/002; H04S 1/005; H04R 5/02; H04R 5/033; H04R 2201/401; H04R 2205/041
See application file for complete search history.

(56) References Cited

U.S. PATENT DOCUMENTS 8,768,496 B2 7/2014 Katz et al.
2006/0067548 A1* 3/2006 Slaney ..... H04S 1/002 381/303
2008/0137870 A1 6/2008 Nicol et al.
2012/0183161 A1* 7/2012 Agevik ..... H04S 7/302 381/303
2013/0169779 A1* 7/2013 Pedersen ..... G06K 9/00362 348/77
2014/0376754 A1* 12/2014 Banerjea ..... H04S 3/004 381/311
2015/0293655 A1* 10/2015 Tan ..... G06F 3/0486 715/727

OTHER PUBLICATIONS

Kickstarter, NEOH: the first smart 3D audio headphones by 3D Sound Labs https://www.kickstarter.com/projects/2019287550/neoh-the-first-smart-3d-audio-headphones, as accessed Mar. 23, 2015, 30 pages, Greenpoint, Brooklyn, United States.

* cited by examiner

*Primary Examiner* — Thang Tran
(74) *Attorney, Agent, or Firm* — Thorpe North & Western LLP

(57) ABSTRACT

A technology for creating head-related transfer functions that are customized for a pinna of a human is described. The method may include capturing a plurality of digital images of a human pinna using a camera. The method may also include generating a 3D (three-dimensional) digital model of the human pinna using the digital images. In addition, the method may also include determining a head related transfer function (HRTF) that is customized for the human pinna using the 3D digital model. The HRTF can be associated with a user profile and the user profile may include sound output customization information for a speaker arrangement capable of producing virtual surround sound. The customized HRTF may then be used by an application in association with a specific user profile to produce a virtual surround sound experience through headphones.

19 Claims, 8 Drawing Sheets

CUSTOMIZED HEAD-RELATED TRANSFER FUNCTIONS

BACKGROUND

Systems that provide stereophonic and surround-sound effects can enhance consumer experiences in many contexts. In the entertainment industry, for example, stereophonic and surround-sound systems may be used to provide a more realistic feel for movies, video games, and audio tracks. In recent years, researchers have begun to investigate methods for enhancing the audio experience for consumers by attempting to create spatial sound reproduction systems (also called 3D audio, virtual auditory display, virtual auditory space, and virtual acoustic imaging systems) that can make audio playback seem to a consumer as though a given sound originates from a direction, regardless of whether there is actually a speaker situated in the position from which the sound seems to originate. Some of these approaches, such as the wave field synthesis method and the loudspeakers-walls method, use a large number of speakers (e.g., one to three hundred speakers). Others, such as the virtual surround sound method, use sophisticated sound wave modification methods, which may incorporate head-related transfer functions (HRTFs) to simulate spatial sound using a few speakers (e.g., two or three in-line speakers).

A head-related transfer function, which is also sometimes referred to as an external-ear transfer function, is a function that is meant to model the way in which an external ear transforms sounds (i.e., an acoustic signals) heard by a human. The external ear, including the pinna, has transforming effects on sound waves that are ultimately perceived by the eardrum (i.e., the tympanic membrane) in humans. The external ear can, for example, act as a filter that reduces low frequencies, a resonator that enhances middle frequencies, and a directionally dependent filter at high frequencies that assists with spatial perception. Ideally, if an HRTF is accurate, the HRTF can be used by spatial sound reproduction systems to assist in creating the desired illusion that sound originates from a specific direction relative to a user.

DETAILED DESCRIPTION

Figure 1:
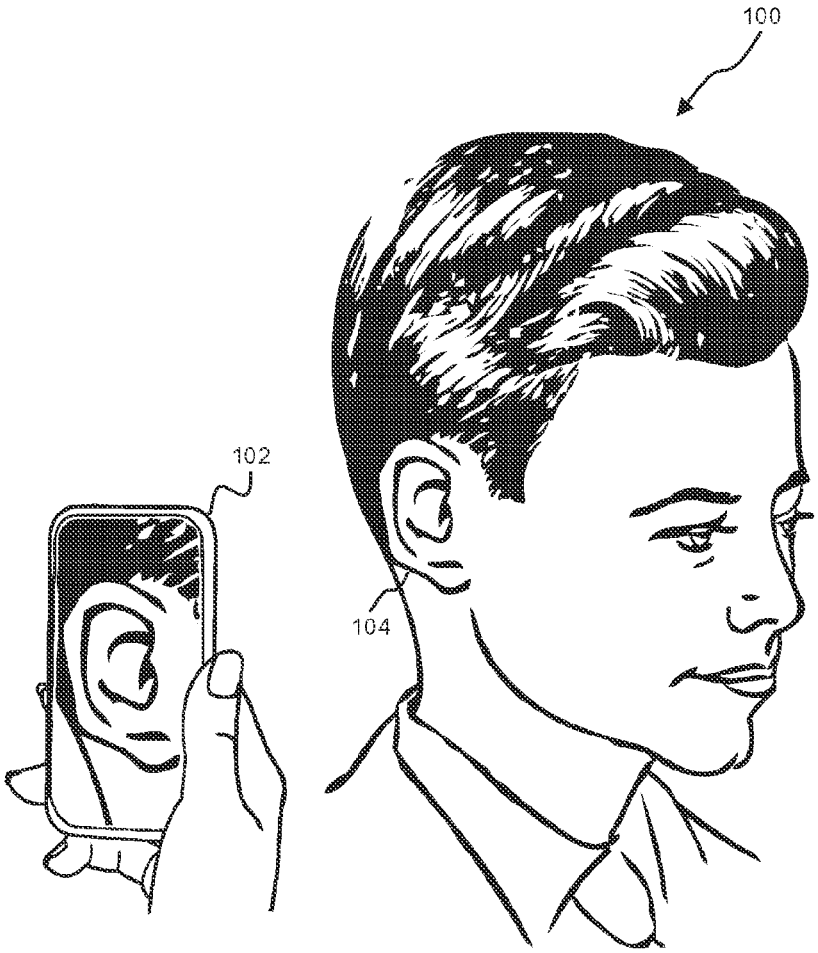
FIG. 1 illustrates a smartphone being used to take a digital photo of a user's pinna in accordance with an example.

A technology is provided to generate a customized head-related transfer function (HRTF) for a user using image sensors, spatial sensors or other sensors. The customized HRTF may then be used in conjunction with a simulated spatial sound reproduction system in order to provide the user with a customized listening experience. Multiple captures of a human pinna may be obtained using a camera or another sensor type (e.g., infrared sensor, laser scanner, etc.). For instance, the captures may be digital images (e.g., still photos, video, infrared, etc.), and the camera may be a digital camera that is integrated into a smartphone. The images in the plurality of digital images may be taken from different viewing perspectives.

A 3D digital model of the human pinna may be generated using the digital images or sensor data. This 3D digital model may be created by applying one or more photogrammetric methods using the digital images or another 3D digital modeling technique using captured sensor data. An HRTF that is customized for the human pinna may be determined using the 3D digital model. A set of morphological parameters may be identified that describes the human pinna, and HRTFs may be generated using the morphological parameters using known methods for generating HRTFs. The HRTF that is customized for the human pinna may be used to provide virtual surround sound through headphones or another type of speaker arrangement. An application that provides audio output may, for example, use the HRTF that is customized for the human pinna to configure the audio output such that a virtual surround sound effect is produced when the audio output is heard through the speaker arrangement and the surround sound effect is customized for the unique pinna shape of the user who is listening to the audio output to provide a more realistic virtual surround sound effect.

In one example use case, a user may wish to view a movie on a portable device and listen to the movie's audio output through a pair of headphones. The user may wish to hear the audio output using virtual surround sound. While the user's headphones may be enabled to use existing virtual surround sound technology, the headphones may initially be configured to use a generalized, one-size-fits-all HRTF because no customized HRTF is immediately available for this particular user. A one-size-fits-all HRTF may be a convenient approach to provide virtual surround-sound functionality because creating customized HRTFs for individual customers may consume an inconvenient amount of time and require expensive specialized equipment (e.g., molding paste and specialized electronic equipment) for modeling the customer's pinna. However, due to the unique shape of the user's pinna, a generalized HRTF may fail to accurately reproduce the intended listening experience for the user. This technology may be used to generate a three-dimensional (3D) digital model of the user's pinna by using equipment available to consumers and in turn create a customized HRTF for the user. As a result, a customized HRTF may be provided to applications that provide sound output in order to supply the user with a more accurate simulated spatial sound reproduction.

In another example, a user may wish to view a movie on a television that is in communication with a virtual surround sound speaker arrangement, such as a soundbar. A customized HRTF may be provided using this technology such that the sound generated by the soundbar may be adjusted to supply the user with a more accurate simulated spatial sound reproduction.

FIG. 1 illustrates an example of a portion of a technology that may be used to generate a 3D digital model of a user's pinna without the use of molding pastes, highly specialized equipment, or other similar systems. A smartphone 102 may be equipped with a built-in digital camera. The digital camera in the smartphone 102 may be used to take two or more digital images of a pinna 104 belonging to a user 100. In another configuration of the technology, a video may be taken of the user's pinna and/or head area. Then, one or more of the digital images may be still frames that are extracted from a video recording taken of the pinna 104 using a video mode of the smartphone 102. In addition, since some HRTFs may incorporate information from other parts of the human body, such as the head and the shoulders, digital images that include portions of the head and shoulders of the user 100 may also be used to incorporate other portions of the human torso into the creation of the HRTF.

While the smartphone 102 is illustrated in FIG. 1, many different types of electronic devices that are able to access photos from digital cameras or devices that incorporate digital cameras into the device may also be used to receive the plurality of digital images of the pinna 104 belonging to the user 100. Some non-limiting examples of other electronic devices that can obtain photos from digital cameras or may incorporate digital cameras include, but are not limited to, a cellular phone, a tablet, a laptop computer, a desktop computer, a dedicated digital camera, a gaming console, or any computing system that comprises a digital camera. In addition, the digital camera used to take the digital images of the pinna 104 may be a visible light camera or an infrared camera.

The digital images may then be provided to a 3D modeling process and be used to create a 3D digital model of the pinna 104. In embodiments where digital images of the head and shoulders are also taken, the digital images can also be used to create a 3D digital model of the user's head and/or shoulders. For example, photogrammetric techniques may be used to determine depth by cross-correlating feature points across multiple photos taken from different perspectives. Once a point in one photo and a point in another photo are correlated—i.e., determined to represent the same point in space—triangulation methods can be applied to determine the depth of the point in space. If the depths of many different points in space are determined, a field of points representing the imaged pinna can be assembled. Where desired, regression techniques and interpolation techniques can be used to connect the points in space to a form grid-like representation of the imaged pinna.

In some configurations where the digital images are taken using a camera, a reference object may be included in the images alongside the user's pinna. The reference object may be any object of a known size (e.g., a coin, a dollar bill, a ruler with measuring indicia). This reference object may be used in the 3D modeling process to help determine the proper scale of the 3D digital model.

The 3D modeling of this technology may include software that applies one or more known photogrammetric methods in order to generate a 3D digital model of the pinna 104 (and of the head and/or shoulders in some configurations) using the digital images. Some non-limiting examples of commercially available software that generate 3D digital models of objects using a plurality of digital images include PATCH-BASED MULTI-VIEW STEREO (PMVS), AUTODESK 123D CATCH, RECAP PHOTO, AGISOFT PHOTOSCAN, INSIGHT3D, ACUTE3D SMART3D CAPTURE, PHOTOMODEL3D GUI, IMAGEMODELER, and PHOTOSCULPT.

The 3D modeling process may also comprise computer hardware that is able store and/or execute the software that comprises the 3D modeling process. The 3D modeling process may, for example, be stored on one or more digital memory devices and be executed by one or more processors. The one or more digital memory devices and processors may be situated locally (e.g., on the smartphone 102) or on one or more remote computing units (e.g., servers) that are in communication with the smartphone through a wired or wireless connection (e.g., through a wireless network or through a wired network connection).

A 3D digital model may be stored in, but is not limited to, a file or set of files and these files may be used in conjunction with a 3D geometry modeler to produce a representation with 3D perspective of one or more surfaces of the pinna that are described in the file or set of files. As used herein, the term "3D digital model" may refer to any representation which uses 3D points in a 3D space. The 3D digital model may be viewable to an end user and may be rendered to images that use 3D perspective and the images may be viewable on two-dimensional (2D) displays or 2D outputs such as flat screens. However, viewing of the 3D digital model is not necessary in order to be able use the 3D digital model in this technology. The 3D digital model and file (or files) containing the 3D digital model may include geometry for surfaces or objects representing the pinna. If the 3D digital model is going to be rendered as a viewable image the 3D digital model and files may include: textures, lighting information, background information or images, and other resources that may be needed to fully render the 3D digital model. Some non-limiting examples of schemes that may be used to represent the geometry and objects in 3D digital models include polygonal modeling, curve modeling, and digital sculpting.

The 3D digital model of the user's pinna can then be provided to computing an HRTF. The HRTF generation process may compute a plurality of morphological parameters that describe one or more dimensions of the user's pinna using the 3D digital model. The HRTF generation process may also use the plurality of morphological parameters to determine a customized HRTF for the user using one or more known methods for determining an HRTF. The HRTF generation process may then provide the customized HRTF to one or more applications to enable those applications to provide the user with a more accurate spatial sound reproduction. For example, the customized HRTF can be incorporated into a virtual surround sound system which generates output to a user through headphones.

The HRTF generation process may use hardware that is able store and/or execute the operations that are performed by the process. The HRTF generation process may, for example, be stored on one or more digital memory devices and be executed by one or more processors. The one or more digital memory devices or processors may be situated locally (e.g., on the smartphone 102) or on one or more remote computing units (e.g., servers) that are in communication with the smartphone through a wired or wireless connection.

While digital images are one type of sensor reading that may be used by a 3D modeling process to generate a 3D digital model of human pinna (and head and shoulders in some configurations), other types of digital sensor readings made on a pinna may also be used. For example, digital sensor readings from laser scanners, structured-laser-light-based 3-D scanners, projected-light stripe systems, LiDAR (Light Detection And Ranging), radar, sonar, time-of-flight (TOF) sensors, or other sensors that can sense range or anatomical topology may be used. In some examples, a projection device, such as an infrared projector, may be used in conjunction with digital sensors in order to assist in generating the digital sensor readings.

Figure 2:
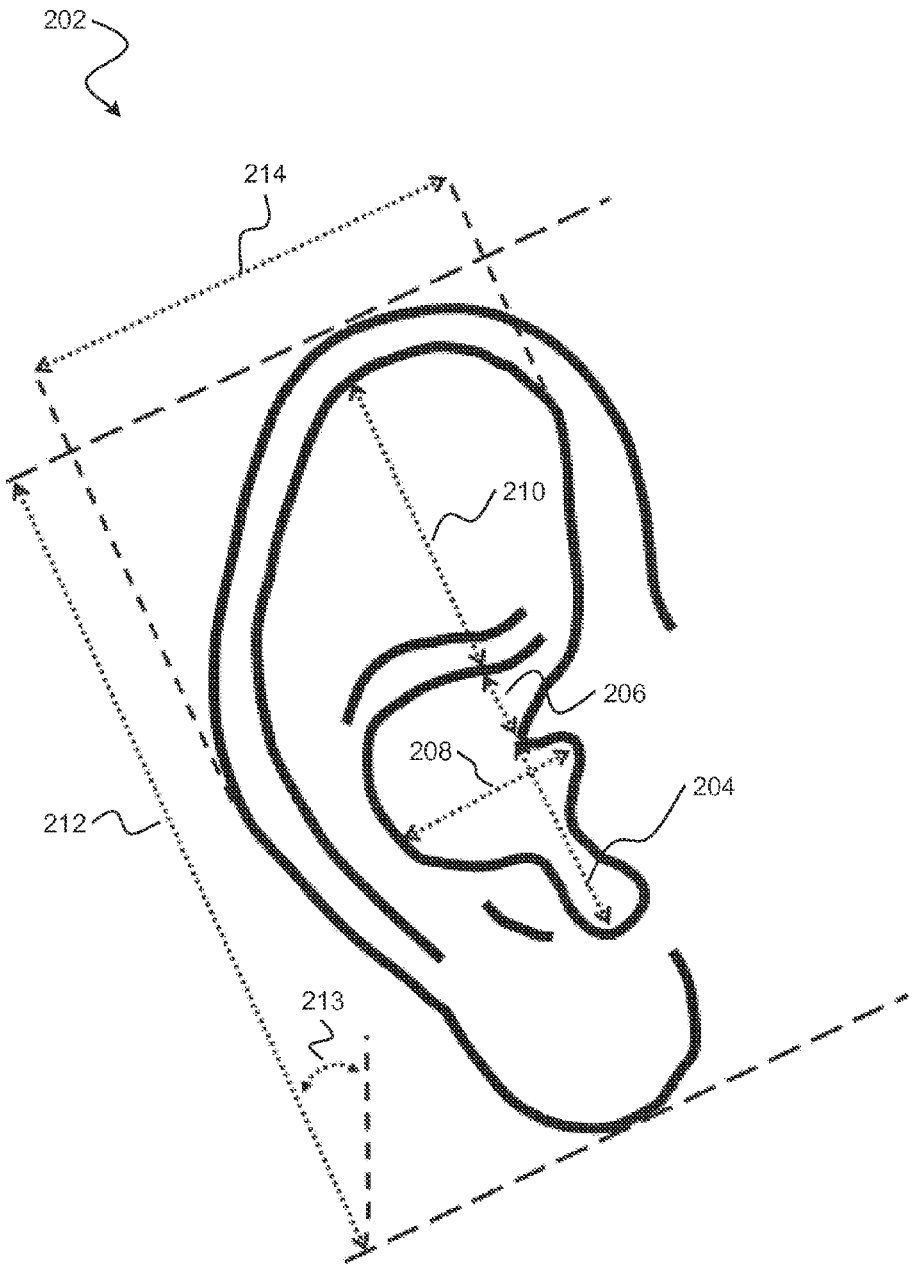
FIG. 2 illustrates several different types of measurements that may be made on a user's pinna in accordance with an example.
Figure 3:
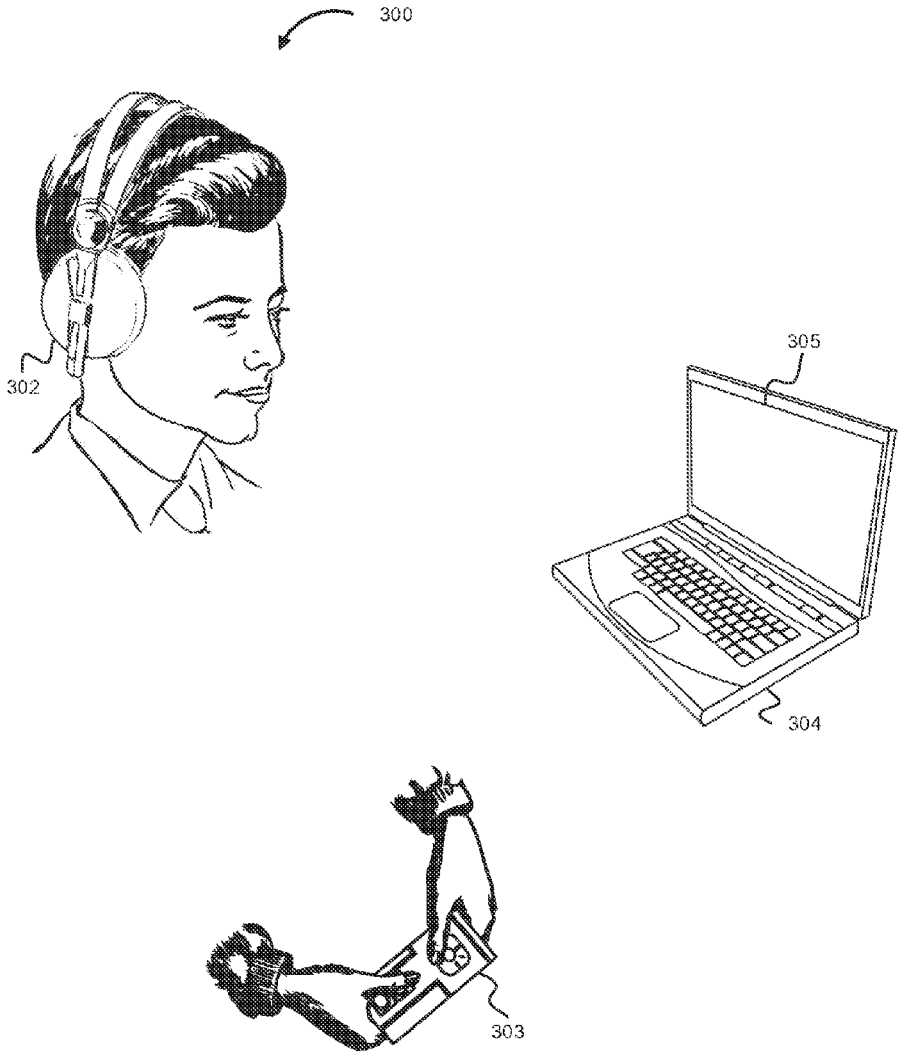
FIG. 3 illustrates a user wearing a pair of circumaural headphones while playing a video game in accordance with an example.

FIG. 2 illustrates several examples of morphological parameters that describe one or more dimensions of a human pinna 202 that may be computed by the HRTF generation process using the 3D digital model. The cavum height 204, the cymba height 206, the cavum width 208, the fossa height 210, the pinna height 212, the pinna rotation angle 213, and the pinna width 214 are all examples of morphological parameters describing a human pinna that may be computed and used by the HRTF generation process to determine an HRTF that is customized to a user's pinna. As illustrated in FIG. 3, a user 300 may listen to a spatialized sound reproduction through a pair of headphones 302 while using an application that receives the customized HRTF from the HRTF generation process. The application may be a video game, a simulator, or another application which may also provide visual output to the user 300 through a display 305. The display 305 may be in communication with a computing device 304 that is running the application. Alternatively, the HRTF may be incorporated into a sound driver which other applications can call. The applications or drivers on the computing device 304 may provide the spatial sound reproduction to the headphones 302 using a signal transferred via a wired or wireless connection.

Some examples of the present technology may be applied in an interactive gaming environment in order to allow the spatial sound experience of a user to be dynamically adjusted in response to changing gameplay or content that the user is accessing. The gameplay or content may change in response to user input that controls an avatar or other environmental aspects in the interactive gaming environment. In some configurations, an audio signal associated with the interactive gaming environment may be provided through streaming over a network to a computing device 304. As one example, spatially oriented sound may be produced for an application that may be depicting a virtual three-dimensional (3D) environment in which an avatar corresponding to the user 300 is situated. The user 300 may control the avatar through a control peripheral 303 that communicates with the computing device 304 using a signal transferred via a wired or wireless connection. The spatial sound reproduction that is provided to the user 300 through the headphones 302 may be configured to simulate the listening experience of the avatar based on the avatar's orientation and/or position in the virtual three-dimensional (3D) environment provided by the application and the spatially oriented sound sources in the 3D environment. In one non-limiting example, the virtual three-dimensional (3D) environment may include a rushing waterfall that is located above and to the left relative to the avatar. Using the customized HRTF function, the headphones 302 may make the sound of the waterfall seem to originate from the upward-left direction relative to the user 300. In response, the user 300 may use the control peripheral 303 to rotate the avatar and face the waterfall. Using the customized HRTF function, the headphones 302 may make an immediate adjustment so that the sound of the waterfall then seems to originate from the upward-forward direction relative to the user 300. The user 300 may then use the control peripheral 303 to direct the avatar to approach the waterfall. As the avatar approaches the waterfall, the headphones 302 may adjust the sound of the waterfall by increasing the volume and continuing to adjust the virtual origin of the sound relative the orientation of the avatar in the virtual 3D environment, while also taking into account the custom HRTF that was created from the images and/or sensor measurements captured by a user.

In addition to adjusting the virtual origin of the sound, the headphones 302 may also adjust the virtual effects of reflected sound off of objects depicted in the virtual 3D environment. A large boulder, for example, might fall behind the avatar and produce a loud crashing sound that echoes off of a cliff beside the waterfall. The echo effect may be adjusted based on the avatar's distance from, and orientation relative to, the cliff. The user may hear the un-reflected crashing sound originating from the boulder first. A split second later, the user may hear the echo that seems to originate from the cliff. The time delay between the crashing sound and the echo may be adjusted based on the virtual distance between the avatar and the cliff and on the presumptive speed of sound in the virtual environment. The volume of the echo may also be adjusted based on the virtual distance between the avatar and the cliff.

In one example, the headphones 302 may be substantially circumaural (i.e., may substantially enclose the ears of the user 300) in order to mitigate audio interference from sounds that emanate from a source other than the headphones 302. In an additional example configuration, the headphones 302 may also perform active noise control to mitigate audio interference from sounds that emanate from a source other than the headphones. Many active noise control methods that are known in the art may be applied. In other examples, a portion of the headphones may comprise earbuds or other structures that at least partly obstruct the user's auditory canal in order to mitigate audio interference from sounds that emanate from a source other than the headphones.

There are many different types of displays that may be used to show the output of the application. Some non-limiting examples may include liquid crystal displays (LCD), OLED (organic light-emitting diode) displays, AMOLED (active matrix organic light-emitting diode) displays, gas plasma-based flat panel displays, projector displays, transparency viewer displays, head-mounted displays, and cathode ray tube (CRT) displays. In some embodiments, displays may have additional functionality that enables using stereoscopic, holographic, anaglyphic, and other techniques to achieve an illusion of depth.

Figure 4:
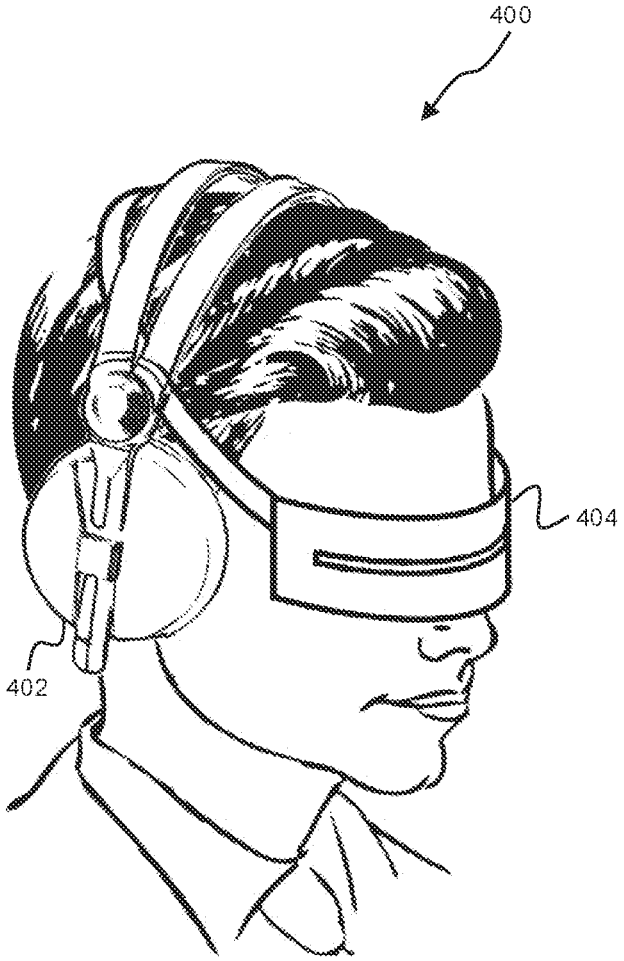
FIG. 4 illustrates a user wearing a virtual-reality headset in accordance with an example.

FIG. 4 illustrates another example of an arrangement that may be used with an application that uses the customized HRTF determined by the HRTF generation process to provide spatial sound reproduction to a user 400 through a pair of headphones 402. An application may be executing using one or more processors and one or more digital memory devices. Examples of the application may include a 3D graphical game, a driving simulation, a flight simulation, a virtual world simulation, and similar applications. The user 400 may wear a virtual-reality headset 404 that has one or more displays situated immediately in front of the user's eyes. The one or more processors and the one or more digital memory devices may be in communication with the virtual-reality headset 404 and the headphones 404 through a wired or wireless connection. In some examples, the virtual-reality headset 404 may have a first display situated in front of the user's left eye and second display situated in front of the user's right eye so that an illusion of depth can be created via stereoscopic viewing of a virtual three-dimensional (3D) environment depicted by the application. The virtual-reality headset 404 and/or the headphones 404 may also be equipped with one or more motion-detecting sensors that may detect changes in the orientation of the user's head and/or eyes. Some examples of motion-detecting sensors may include, but are not limited to: accelerometers, gyroscopes, magnetic sensors (i.e., compasses, etc.), tomographic motion detectors, passive infrared sensors, microwave sensors, ultrasonic sensors, barometers, cameras, and other devices that may be configured to detect changes in movement, as well as combinations thereof.

Input from the one or more motion-detecting sensors may be provided to the application. The application may respond to input from the one or more motion-detecting sensors by adjusting the visual output through the first and second displays. In addition, the application may also respond by adjusting the spatial-sound audio output through the headphones 402 using the customized HRTF. For example, a 3D environment shown by the first and second displays in the virtual-reality headset 404 may represent the interior of a user-controlled racing car in a video game. Suppose there is also an opponent racing car in the 3D environment that is positioned to the right of the user-controlled racing car in an adjacent lane. The application may use the customized HRTF to make the sound of the engine of the opponent racing car seem to originate from the right side of the user's head. If the user 400 turns his head to the right in order to look out the rear view of the user-controlled racing car, the application may receive input from the motion-detecting sensors indicating the change in the orientation of the user's head. In response, the application may adjust the viewing perspective shown through the first and second displays and the audio output from the headphones 404. As a result, the displays may be updated to show the adjusted view and the headphones 402 may be updated to provide spatially adjusted audio output such that the sound of the engine of the opponent racing car now seems to originate from the left side of the user's head. Furthermore, the effects of sound reflection off of objects in the virtual environment, such as the road and the doors and windows of the two cars, may be also be updated accordingly.

Figure 5:
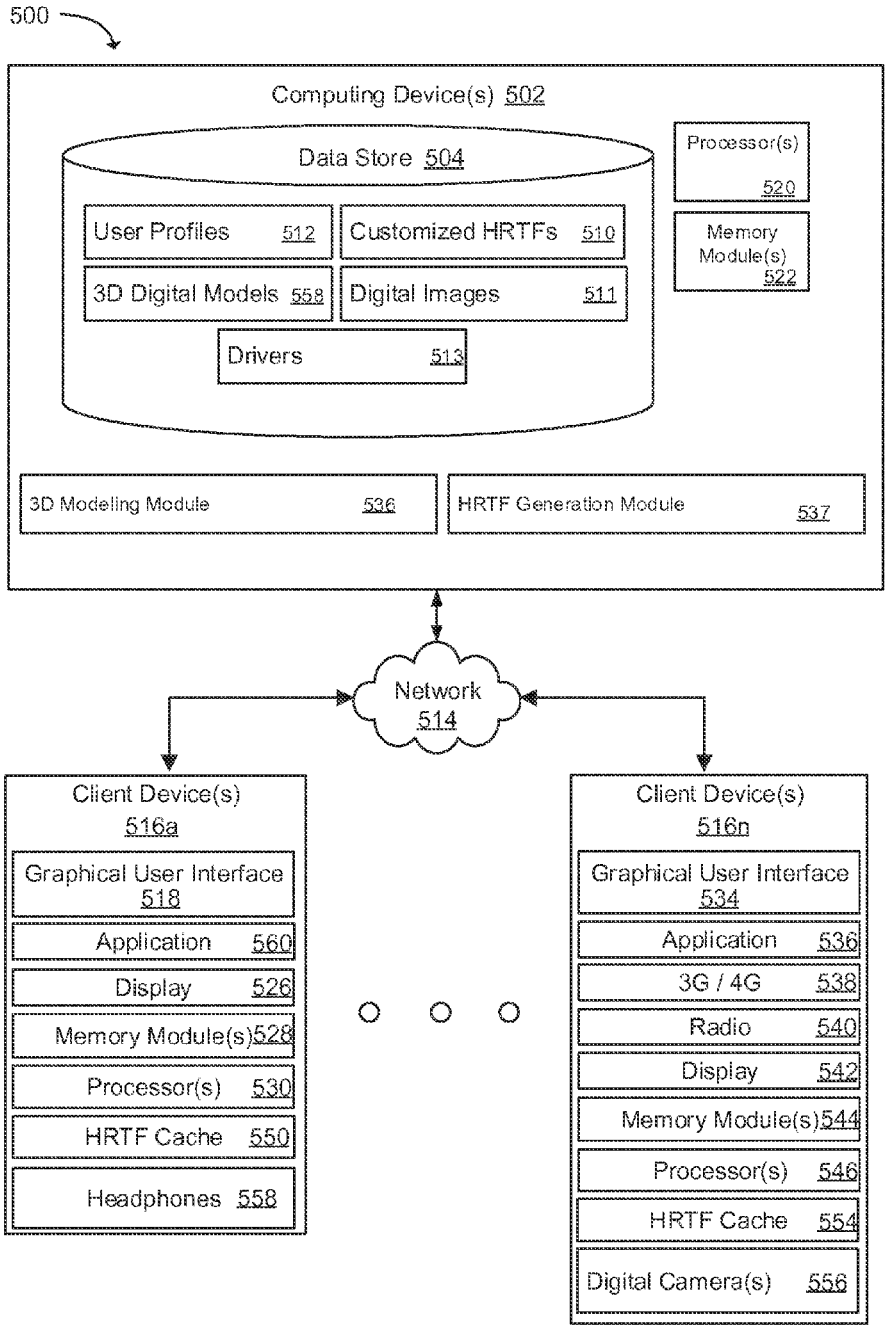
FIG. 5 illustrates a system in which an HRTF that is customized for a user can be generated, stored, and provided to an application that is running on a local computing device in accordance with an example.

FIG. 5 illustrates a system 500 in which an HRTF that is customized for a user can be generated, stored, and used in providing modified audio in accordance with an example. Digital photos or other digital sensor captures of a user's pinna may be provided to a 3D modeling module 536 via a communications network 514. In the case of digital photos, the digital photos may have been taken using a digital camera 556 that is built into a client device 516*n* as illustrated. The 3D modeling module 536 may then apply one or more photogrammetric methods or other 3D modeling methods in order to generate a 3D digital model of the user's pinna using the plurality of digital images (or digital sensor readings). The digital images 511 may be stored with 3D digital models 558 in the data store 504. The HRTF generation module 537 may then compute a plurality of morphological parameters from the 3D digital model that describe one or more dimensions of the user's pinna. The HRTF generation module may use the plurality of morphological parameters to determine a customized HRTF for the user using one or more methods for determining customized HRTFs, as explained above. The customized HRTF may then be stored with the HRTFs 510 in the data store 504. In addition, the customized HRTF may be associated with a user profile corresponding to the user in a set of user profiles 512 that are stored in the data store 504. The user profile may contain sound output customization information that includes the HRTF and other customization settings. For instance, when a user is logged in to play a game, the appropriate user profile may be selected and the associated HRTF and other customization information may be loaded. A user profile may further comprise, for example, a user-name, a password, and a compilation of information that describes the user, such as attributes (e.g., the user's age, gender, preferred application settings, and so forth) and history (e.g., use history or purchase history). In addition, a user profile may comprise settings customized to one or more user sound output preferences (e.g., bass, treble, fade, reverberation, and other effect settings). A user profile may also comprise at least one driver identifier (e.g., a software driver ID, link, pointer or other reference) that identifies a driver for a specific hardware speaker device (e.g., a sound bar or headphones) that are available to the user. The driver may be found in a set of drivers 513 that are stored in the data store 504. The applications 560, 536, which may be executed on client devices 516*a* and 516*n*, respectively, may send a communication to the computing device(s) 502 via the communications network 514 providing information identifying the user and requesting the customized HRTF associated with the user's profile. The computing device(s) 502 may then send a communication with the customized HRTF data to the client devices 516*a* and 516*n* via the communications network 514. The client devices 516*a* and 516*n* may store the customized HRTF in an HRTF cache 550, 554.

In some examples, the customized HRTFs 510 may further include hardware drivers that are customized for specific types of hardware speaker arrangements in addition to being customized for specific users. In this way, a single user in the user profiles 502 may be associated with more than one customized HRTF. For example, a user may be associated with a first customized HRTF that includes a driver for a specific type of headphones and also associated with a second customized HRTF that includes a driver for a specific type of soundbar. In examples where this is the case, a graphical user interface 518, 534 may present the user with an option to select a specific hardware speaker arrangement will be used in conjunction with an application 560, 536 at a given time. The user's selection may be communicated to the computing device(s) 502 via the communications network 514 along with information identifying the user requesting the customized HRTF that is associated with the both the user's profile and the selected hardware speaker arrangement.

Examples of applications that may request the customized HRTF may include, but are not limited to, executable programs such as video games, simulators, music players, movie players, media editing applications, and other types of applications that provide audio output which may provide virtual surround sound or similar modified audio output that provides spatial sound simulation.

The term "data store" may refer to any device or combination of devices capable of storing, accessing, organizing, and/or retrieving data, which may include any combination and number of data servers, relational databases, object oriented databases, simple web storage systems, cloud storage systems, data storage devices, data warehouses, flat files, and data storage configuration in any centralized, distributed, or clustered environment. The storage system components of the data store may include storage systems such as a SAN (Storage Area Network), cloud storage network, volatile or non-volatile RAM, optical media, or hard-drive type media.

The client devices 516*a-n* may contain hardware that may enable the client devices 516*a-n* to connect to the communications network 514 using mobile communication protocols such as 3G, 4G, and/or Long-Term Evolution (LTE) 538. Additionally, client devices 516*a-n* may contain a radio 540 that enables the client devices 516*a-n* to connect to the communications network 514 by way of a wireless local area network connection such as WI-FI or Bluetooth®. The client devices 516*a-n* may include a display 542, 526 such as a liquid crystal display (LCD) screen, gas plasma-based flat panel display, LCD projector, cathode ray tube (CRT), or other types of display devices, etc. The display 542, 526 may include a touchscreen (e.g., an interactive visual display).

The client devices 516*a-n* may also contain other modules, hardware, and software. For example, the client devices 516*a-n* may have a graphical user interface 518, 534 that is designed to receive user input. Client devices may also contain memory device(s) 528, 544 whereupon applications 560, 536 and data may be stored and processors 530, 546 that may be used to execute applications 560, 536.

The various processes and/or other functionality contained on the computing device 502 may be executed on one or more processors 520 that are in communication with one or more memory modules 522 according to various examples. The computing device 502 may comprise, for example, a server or any other system providing computing capability. Alternatively, a number of computing devices 502 may be employed that are arranged, for example, in one or more server banks or computer banks or other arrangements. For purposes of convenience, the computing device 502 is referred to in the singular. However, it is understood that a plurality of computing devices 502 may be employed in the various arrangements as described above. In some configurations, the elements contained in the computing device 502 may located on a client device 516*a-n* rather than a server such that communication between modules does not require a network connection.

The communications network 514 may include any useful computing network, including an intranet, the Internet, a local area network, a wide area network, a wireless data network, or any other such network or combination thereof. Components utilized for such a system may depend at least in part upon the type of network and/or environment selected. Communication over the network may be enabled by wired or wireless connections and combinations thereof.

FIG. 5 illustrates that certain processing modules may be discussed in connection with this technology and these processing modules may be implemented as computing services. In one example configuration, a module may be considered a service with one or more processes executing on a server or other computer hardware. Such services may be centrally hosted functionality or a service application that may receive requests and provide output to other services or consumer devices. For example, modules providing services may be considered on-demand computing that are hosted in a server, cloud, grid, or cluster computing system. An application program interface (API) may be provided for the modules to enable a second module to send requests to and receive output from the first module. Such APIs may also allow third parties to interface with the module and make requests and receive output from the modules. While FIG. 5 illustrates an example of a system that may implement the techniques above, many other similar or different environments are possible. The example environments discussed and illustrated above are merely representative and not limiting.

Figure 6:
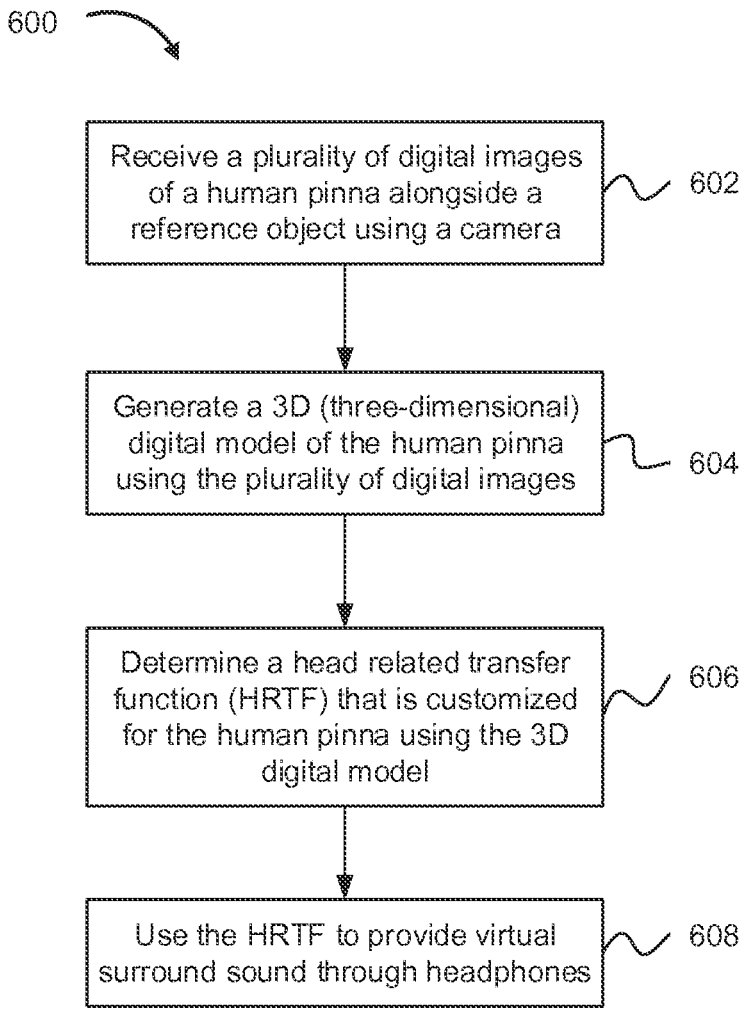
FIG. 6 is a flow chart illustrating a method for creating a customized HRTF for a user using a digital camera in accordance with an example.

FIG. 6 is a flow diagram illustrating an example method 600 for creating a customized HRTF for a human pinna and providing virtual surround sound through headphones based on a 3D digital model of the human pinna. Beginning in block 602, a plurality of digital images of a human pinna may be captured using a camera. The camera may be a digital camera that is integrated in a smartphone. Various images in the plurality of digital images may be taken from different viewing perspectives.

As in block 604, a 3D digital model of the human pinna may be generated using the plurality of digital images. This may be accomplished by applying one or more photogrammetric methods using the plurality of digital images. As in block 606, an HRTF that is customized by the human pinna may be determined or generated using the 3D digital model. This may be accomplished, for example, by determining a set of morphological parameters that describe the human pinna and using the morphological parameters in conjunction with one or more known methods for generating HRTFs. As in block 608, the HRTF that is customized for the human pinna may be used to provide virtual surround sound through headphones. An application that provides audio output may, for example, use the HRTF that is customized for the human pinna to configure the audio output such that an improved virtual surround sound effect is produced when the audio output is heard through headphones.

Figure 7:
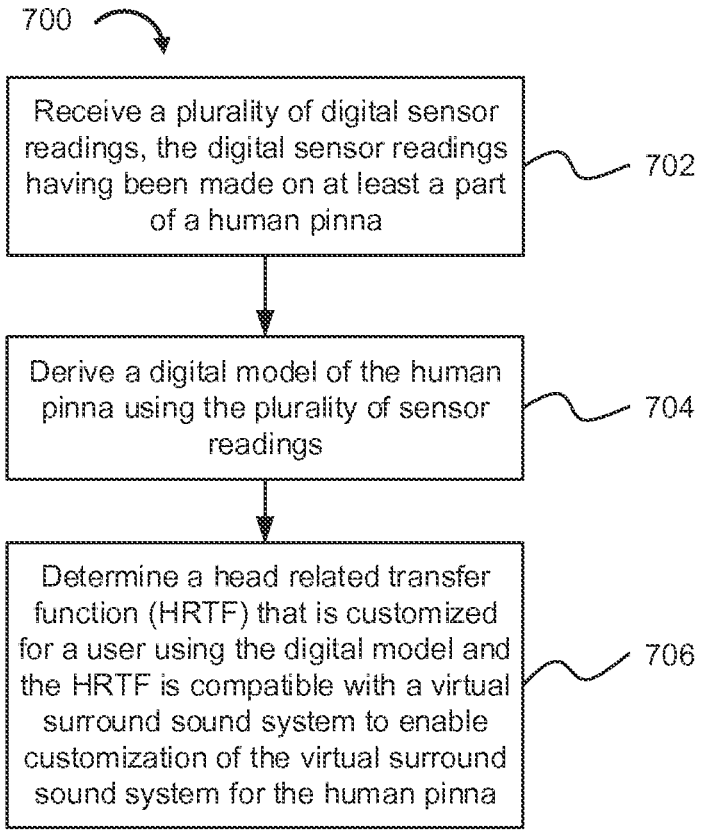
FIG. 7 is a flow chart illustrating a method for creating a customized HRTF for a user using digital sensor readings in accordance with an example.

FIG. 7 is a flow diagram illustrating an example method 700 for creating a customized HRTF for a human pinna in accordance with an example. As in block 702, a plurality of digital sensor readings made on at least a part of a human pinna may be received. The plurality of digital sensor readings may comprise digital images taken using a visible-light camera or an infrared camera. The plurality of digital sensor readings may also comprise other types of digital sensor readings, such as readings from laser scanners, structured-laser-light-based 3-D scanners, projected light stripe systems, LiDAR (Light Detection And Ranging), radar, sonar, time-of-flight (TOF) sensors, or other sensors that can sense range and/or topology of physical objects. In some examples, a projection device, such as an infrared projector, may be used in conjunction with the digital sensors in order to assist in generating the digital sensor readings.

In block 704, a digital model of the human pinna may be derived using the plurality of digital sensor readings. For example, where the digital sensor readings are digital images, one or more known photogrammetry methods may applied using the digital sensor readings to derive the digital model of the human pinna. In other digital sensor readings, the actual depth of points sensed may be recorded and used to develop the 3D digital model. As in block 706, an HRTF that is customized for the human pinna may be determined using the digital model of the human pinna and the HRTF may be compatible with a virtual surround sound system to enable customization of the virtual surround sound system for the human pinna.

Figure 8:
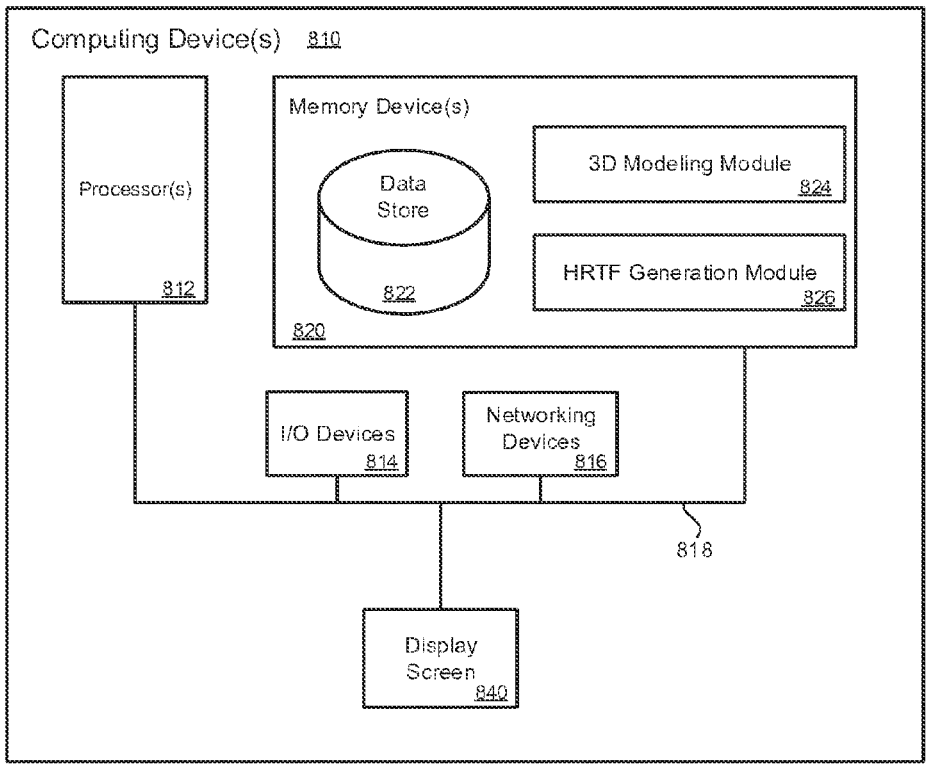
FIG. 8 is a block diagram illustrating a computing device that is configured to create a customized HRTF for a user in accordance with an example.

FIG. 8 illustrates a computing device 810 on which modules of this technology may execute. The computing device 810 may include one or more processors 812 that are in communication with memory devices 820. The computing device 810 may include a local communication interface 818 for the components in the computing device. For example, the local communication interface 818 may be a local data bus and/or any related address or control busses as may be desired.

The memory device 820 may contain modules that are executable by the processor(s) 812 and data for the modules. Located in the memory device 820 are services and modules executable by the processor. For example, a 3D modeling 824 (e.g., data for the modules), an HRTF generation module 826, and other modules may be located in the memory device 820. The modules may execute the functions described earlier. A data store 822 may also be located in the memory device 820 for storing data related to the modules and other applications along with an operating system that is executable by the processor(s) 812.

Other applications may also be stored in the memory device 820 and may be executable by the processor(s) 812. Components or modules discussed in this description may be implemented in the form of software using high programming level languages that are compiled, interpreted, or executed using a hybrid of the methods.

The computing device may also have access to I/O (input/output) devices 814 that are usable by the computing devices. An example of an I/O device is a display screen 840 that is available to display output from the computing devices. Other known I/O devices may be used with the computing device as desired. Networking devices 816 and similar communication devices may be included in the computing device. The networking devices 816 may be wired or wireless networking devices that connect to the internet, a LAN, WAN, or other computing network.

The components or modules that are shown as being stored in the memory device 820 may be executed by the processor(s) 812. The term "executable" may mean a program file that is in a form that may be executed by a processor 812. For example, a program in a higher level language may be compiled into machine code in a format that may be loaded into a random access portion of the memory device 820 and executed by the processor 812, or source code may be loaded by another executable program and interpreted to generate instructions in a random access portion of the memory to be executed by a processor. The executable program may be stored in any portion or component of the memory device 820. For example, the memory device 820 may be random access memory (RAM), read only memory (ROM), flash memory, solid state memory, memory card, a hard drive, optical disk, floppy disk, magnetic tape, or any other memory components.

The processor 812 may represent multiple processors and the memory 820 may represent multiple memory units that operate in parallel to the processing circuits. This may provide parallel processing channels for the processes and data in the system. The local interface 818 may be used as a network to facilitate communication between any of the multiple processors and multiple memories. The local interface 818 may use additional systems designed for coordinating communication such as load balancing, bulk data transfer, and similar systems.

While the flowcharts presented for this technology may imply a specific order of execution, the order of execution may differ from what is illustrated. For example, the order of two more blocks may be rearranged relative to the order shown. Further, two or more blocks shown in succession may be executed in parallel or with partial parallelization. In some configurations, one or more blocks shown in the flow chart may be omitted or skipped. Any number of counters, state variables, warning semaphores, or messages may be added to the logical flow for enhanced utility, accounting, performance, measurement, troubleshooting, or other purposes.

Some of the functional units described in this specification have been labeled as modules in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like.

Modules may also be implemented in software for execution by various types of processors. An identified module of executable code may, for instance, comprise one or more blocks of computer instructions that may be organized as an object, procedure, or function. Nevertheless, the executables of an identified module need not be physically located together, but may comprise disparate instructions stored in different locations which comprise the module and achieve the stated purpose for the module when joined logically together.

Indeed, a module of executable code may be a single instruction or many instructions and may even be distributed over several different code segments, among different programs, and across several memory devices. Similarly, operational data may be identified and illustrated herein within modules and may be embodied in any suitable form and organized within any suitable type of data structure. The operational data may be collected as a single data set, or may be distributed over different locations including over different storage devices. The modules may be passive or active, including agents operable to perform desired functions.

The technology described here may also be stored on a computer readable storage medium that includes volatile and non-volatile, removable and non-removable media implemented with any technology for the storage of information such as computer readable instructions, data structures, program modules, or other data. Computer readable storage media include, but are not limited to, non-transitory media such as RAM, ROM, EEPROM, flash memory or other memory technology, CD-ROM, digital versatile disks (DVD) or other optical storage, magnetic cassettes, magnetic tapes, magnetic disk storage or other magnetic storage devices, or any other computer storage medium which may be used to store the desired information and described technology.

The devices described herein may also contain communication connections or networking apparatuses and networking connections that allow the devices to communicate with other devices. Communication connections are an example of communication media. Communication media typically embodies computer readable instructions, data structures, program modules, and other data in a modulated data signal such as a carrier wave or other transport mechanism and includes any information delivery media. A "modulated data signal" means a signal that has one or more of its characteristics set or changed in such a manner as to encode information in the signal. By way of example and not limitation, communication media includes wired media such as a wired network or direct-wired connection and wireless media such as acoustic, radio frequency, infrared, and other wireless media. The term computer readable media as used herein includes communication media.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

The technology described here may also be stored on a computer readable storage medium that includes volatile and non-volatile, removable and non-removable media implemented with any technology for the storage of information such as computer readable instructions, data structures, program modules, or other data. Computer readable storage media include, but is not limited to, RAM, ROM, EEPROM, flash memory or other memory technology, CD-ROM, digital versatile disks (DVD) or other optical storage, magnetic cassettes, magnetic tapes, magnetic disk storage or other magnetic storage devices, or any other computer storage medium which may be used to store the desired information and described technology.

What is claimed is:

1. A method for generating a head related transfer function that is customized for a user for use in an interactive gaming environment, the method comprising:

receiving a plurality of digital images of a human pinna and a reference object using a camera;

generating a 3D (three-dimensional) digital model of the human pinna using the plurality of images, the 3D digital model representing the three-dimensional (3D) structure of the human pinna;

deriving a head related transfer function (HRTF) that is customized for the human pinna using the 3D digital model;

associating the HRTF with a user profile, the user profile comprising settings customized to at least one user sound output preference and a driver identifier for headphones capable of producing virtual surround sound;

generating an audio signal that has been modified using the HRTF, a driver associated with the driver identifier, and at least one user sound output preference to provide virtual surround sound; and streaming the audio signal that was customized to headphones.

2. The method as in claim 1, wherein the user profile further comprises an additional driver identifier for a speaker device capable of producing virtual surround sound.

3. The method of claim 1, wherein the audio signal represents sound associated with the interactive gaming environment and takes into account interactive content being accessed.

4. The method of claim 3, wherein the user provides control information to control an avatar in a 3D environment depicted in the interactive gaming environment and the audio signal is adjusted based at least in part on changes of the avatar and changes in the 3D environment based at least in part on the control information.

5. The method of claim 1, wherein the headphones perform noise control to mitigate audio interference from sounds that emanate from a source other than the headphones.

6. A method for generating a head related transfer function that is customized for a user for use in an interactive gaming environment, comprising:

receiving a plurality of digital sensor readings, the digital sensor readings are based on reading at least a portion of a human pinna;

deriving a digital model of the human pinna using the plurality of sensor readings, the digital model representing at least a portion of a three-dimensional (3D) structure of the human pinna;

determining a head related transfer function (HRTF) that is customized for a user using the digital model and the HRTF;

associating the HRTF with a user profile, the user profile comprising at least one user sound output preference and a driver identifier for a speaker arrangement capable of producing virtual surround sound; and providing the HRTF and the driver identifier to an application to enable the application to provide virtual surround sound to the user through the speaker arrangement.

7. The method of claim 6, wherein the digital sensor readings comprise at least one of digital photographs, digital video footage, readings from laser scanners, readings from structured-laser-light-based 3-D scanners, readings from projected light stripe systems, readings from LiDAR (Light Detection And Ranging), readings from radar, readings from sonar, or readings from time-of-flight (TOF) sensors.

8. The method of claim 6, wherein the application is configured to use the HRTF and input from one or more motion-detecting sensors to provide the customized virtual surround sound experience to the user through the speaker arrangement.

9. The method of claim 8, wherein the one or more motion-detecting sensors comprise at least one of: an accelerometer, a gyroscope, a magnetic sensor, a tomographic motion detector, a passive infrared sensor, a microwave sensor, an ultrasonic sensor, a barometer, or a camera.

10. The method of claim 9, wherein the application comprises an interactive gaming environment depicting a 3D environment and the application adjusts the virtual surround sound experience at least in part based on changes in the 3D environment relative to an avatar that is in the 3D environment, the changes being based at least in part on the input from the one or more motion-detecting sensors.

11. The method of claim 10, wherein the motion-detecting sensors are mounted to a user's head and the avatar is at least partly controlled by movement of the user's head that is detected using the motion-detecting sensors.

12. The method of claim 6, wherein the speaker arrangement comprises headphones that are circumaural in order to mitigate audio interference from sounds that emanate from a source other than the headphones.

13. The method of claim 6, wherein the speaker arrangement comprises headphones that perform noise control to mitigate audio interference from sounds from a source other than the headphones.

14. The method of claim 6, wherein the user profile further comprises user preferences including at least one of: a bass level, a treble level, or a fade level.

15. The method of claim 6, wherein the user profile further comprises a second driver identifier for a second speaker arrangement capable of producing virtual surround sound.

16. A non-transitory computer-readable medium storing instructions thereon which, when executed by one or more processors, perform the following:

receiving a plurality of digital sensor readings, the digital sensor readings are based on reading at least a part of a user's pinna and a user's head;

deriving a digital model using the plurality of sensor readings, the digital model representing at least a part of the three-dimensional (3D) structure of the user's pinna and the user's head;

determining a head related transfer function (HRTF) that is customized for a user using the digital model;

associating the HRTF with a user profile, the user profile comprising sound output customization information and a driver identifier for a speaker arrangement capable of producing virtual surround sound; and providing the HRTF and the driver identifier to an application to enable the application to provide virtual surround sound to the user through the speaker arrangement.

17. The non-transitory computer-readable medium of claim 16, wherein the plurality of digital sensor readings comprise one or more of digital photographs or digital video footage.

18. The non-transitory computer-readable medium of claim 16, wherein the instructions, when executed by the one or more processors, further perform the following:

using the HRTF that is customized for the user to customize a streaming audio signal for the speaker arrangement to enable an application to provide customized virtual surround sound for the user.

19. The non-transitory computer-readable medium of claim 16, wherein the instructions, when executed by the one or more processors, further perform the following:

using the HRTF to provide a customized virtual surround sound experience to the user through headphones.

* * * * *